US008006525B2

(12) United States Patent
Huang et al.

(10) Patent No.: US 8,006,525 B2
(45) Date of Patent: Aug. 30, 2011

(54) TRANSMISSION DEVICE FOR A DOOR LOCK

(75) Inventors: Chao-Ming Huang, Kaohsiung Hsien (TW); Chi-Ming Chen, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 952 days.

(21) Appl. No.: 11/986,259

(22) Filed: Nov. 20, 2007

(65) Prior Publication Data

US 2008/0121001 A1 May 29, 2008

(30) Foreign Application Priority Data

Nov. 23, 2006 (TW) ..... 95143303 A

(51) Int. Cl.
*E05B 47/00* (2006.01)

(52) U.S. Cl. ..... 70/107; 70/218; 70/277; 70/278.7; 70/279.1; 70/472

(58) Field of Classification Search ..... 70/107–111, 70/277, 472, 149, 422, 218, 223, 224, 279.1, 70/278.7; 292/DIG. 27; 192/84.92
See application file for complete search history.

(56) References Cited

U.S. PATENT DOCUMENTS

| | | | | | |
|---|---|---|---|---|---|
| 1,523,413 | A * | 1/1925 | Gent | 192/84.5 |
| 3,512,381 | A * | 5/1970 | Matsunaga | 70/107 |
| 3,748,878 | A * | 7/1973 | Balzano et al. | 70/218 |
| 4,073,527 | A * | 2/1978 | Schlage | 292/347 |
| 4,534,194 | A * | 8/1985 | Aydin | 70/278.2 |
| 4,956,984 | A * | 9/1990 | Chi-Cheng | 70/277 |
| 5,040,391 | A * | 8/1991 | Lin | 70/277 |
| 5,052,534 | A * | 10/1991 | Gustin et al. | 192/53.2 |
| 5,076,120 | A * | 12/1991 | Lin | 81/54 |
| 5,544,507 | A * | 8/1996 | Lin | 70/107 |
| 5,960,656 | A * | 10/1999 | Yao | 70/472 |
| 5,974,912 | A * | 11/1999 | Cheng et al. | 70/472 |
| 6,334,348 | B1 * | 1/2002 | Ming-Chih | 70/472 |
| 7,543,469 | B1 * | 6/2009 | Tseng et al. | 70/472 |
| 2002/0144526 | A1 * | 10/2002 | Ming-Chih | 70/218 |

* cited by examiner

*Primary Examiner* — Lloyd Gall
(74) *Attorney, Agent, or Firm* — William E. Pelton, Esq.; Cooper & Dunham LLP

(57) ABSTRACT

A transmission device for a door lock has a solenoid switch, a driven device and a linkage assembly. The solenoid switch has a solenoid core, a guide tube, a sleeve and a clutch cap. The guide tube is mounted in the solenoid core and has a connecting end. The connecting end is formed on one end of the guide tube and protrudes out of the solenoid core. The sleeve is mounted slidably in the solenoid core and around the guide tube and has at least one engaging tab formed on and protruding from the sleeve at one end adjacent to the connecting end of the guide tube. The clutch cap is mounted around the connecting end of the guide tube and has at least one engaging notch selectively and detachably engaging respectively with a corresponding engaging tab on the sleeve.

20 Claims, 8 Drawing Sheets

TRANSMISSION DEVICE FOR A DOOR LOCK

BACKGROUND OF THE INVENTION

1. Field of the Invention

The present invention relates to a transmission device, and more particularly to a transmission device for a door lock having a solenoid switch to selectively disengage a locking mechanism.

2. Description of Related Art

A traditional door lock is opened using a corresponding key, however advances in technology allow the key to be replaced by an electronic actuator, such as a finger print identifier, a chip detecting sensor and the like; having the advantages of matching biometric, magnetic or electronic data being required to open the door lock. However, a key controlled lock and an electronically controlled lock are individual so a key cannot open the electronically controlled lock.

Therefore, implementing electronically controlled locks means a building manager or the like who may be required to open doors in emergencies must have such access to all locks in a building thereby causing security issues regarding their key card or biometric data.

Additionally, hotels or public buildings may wish to allow temporary access to a facility by issuing a key whilst allowing staff access only during their shift, therefore staff carrying biometric, magnetic or electronic data may only enter an area during shifts or allocated times whilst leaving a record of entering for added security and safety. However, a simple system allowing access using a key or biometric, electronic or magnetic data is required, therefore the present invention tends to provide a transmission device to mitigate or obviate the aforementioned problems.

SUMMARY OF THE INVENTION

The main objective of the invention is to provide a transmission device with a solenoid switch for a door lock that can be opened using a corresponding key or an electronic actuator to improve security and versatility of the lock. The transmission device comprises a solenoid switch, a driven device and a linkage assembly. The solenoid switch comprises a solenoid core, a guide tube, an sleeve and a clutch cap. The solenoid core has a receiving hole defined in the solenoid core and a solenoid coil wound around the solenoid core. The guide tube is mounted in the receiving hole in the solenoid core and has an axial hole and a connecting end. The axial hole is defined through the guide tube. The connecting end is formed on one end of the guide tube and extends out of the receiving hole in the solenoid core. The sleeve is mounted slidably in the receiving hole in the solenoid core and around the guide tube and has at least one engaging tab formed on and protruding from the sleeve at one end facing the connecting end of the guide tube. The clutch cap is mounted around the connecting end of the guide tube and has at least one engaging notch selectively and detachably engaging respectively with corresponding engaging tabs on the sleeve. The driven device is securely connected to the solenoid switch. The linkage assembly is connected to the solenoid switch and comprises an outer linkage, an inner linkage and at least one spring. The outer linkage is connected to the clutch cap of the solenoid switch. The inner linkage is connected to the outer linkage and the driven device. The at least one spring is connected between the inner linkage and the driven device. Therefore, the door lock may be locked by a key or internal mechanism moving the linkage assembly away from engaging the handle.

Then actuating the solenoid coil allows the linkage assembly to engage the handle and allows the door lock to be opened without the corresponding key.

Other objects, advantages and novel features of the invention will become more apparent from the following detailed description when taken in conjunction with the accompanying drawings.

DETAILED DESCRIPTION OF PREFERRED EMBODIMENT

Figure 1:
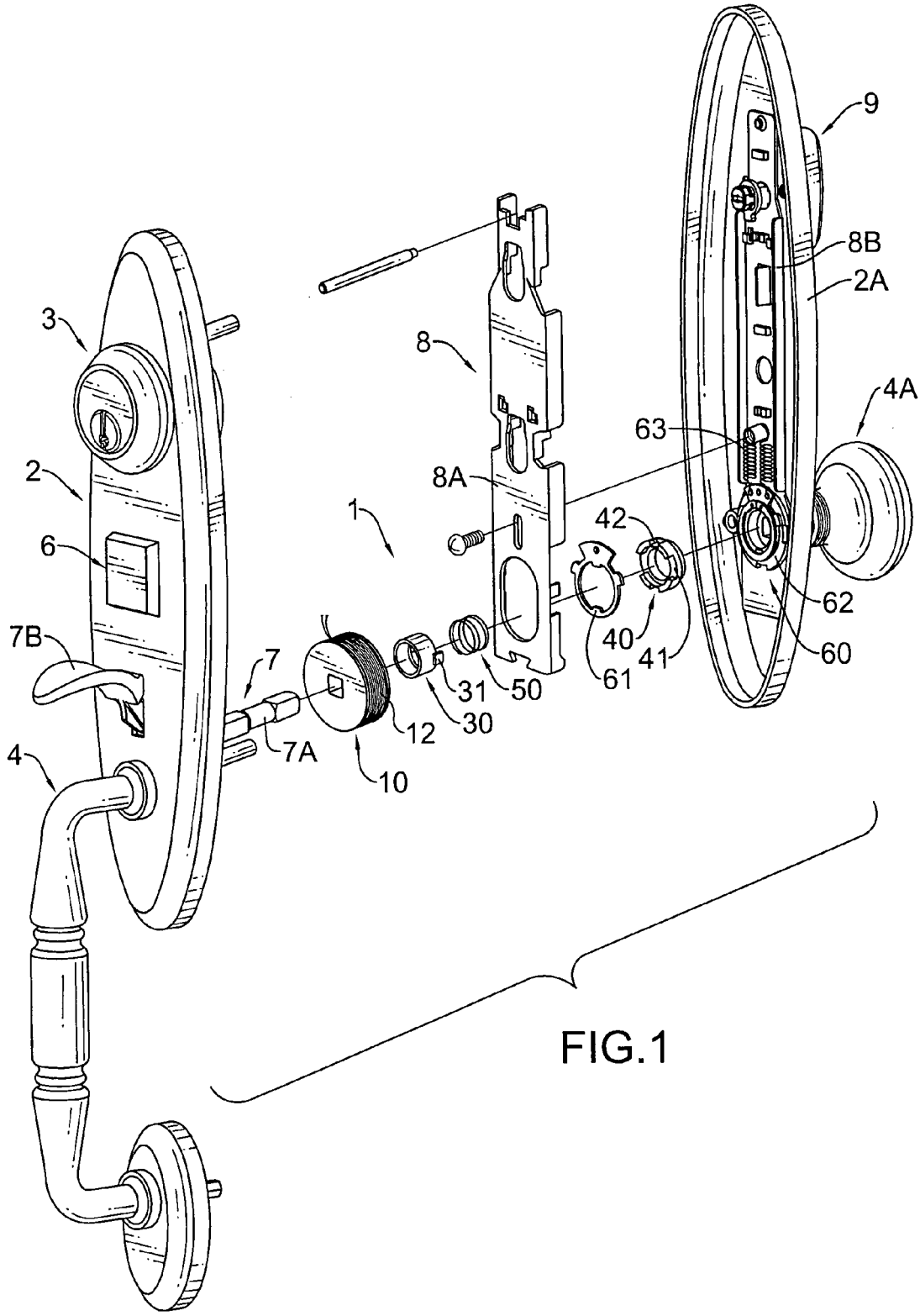
FIG. 1 is a partially exploded perspective view of a door lock with a transmission device in accordance with the present invention.
Figure 2:
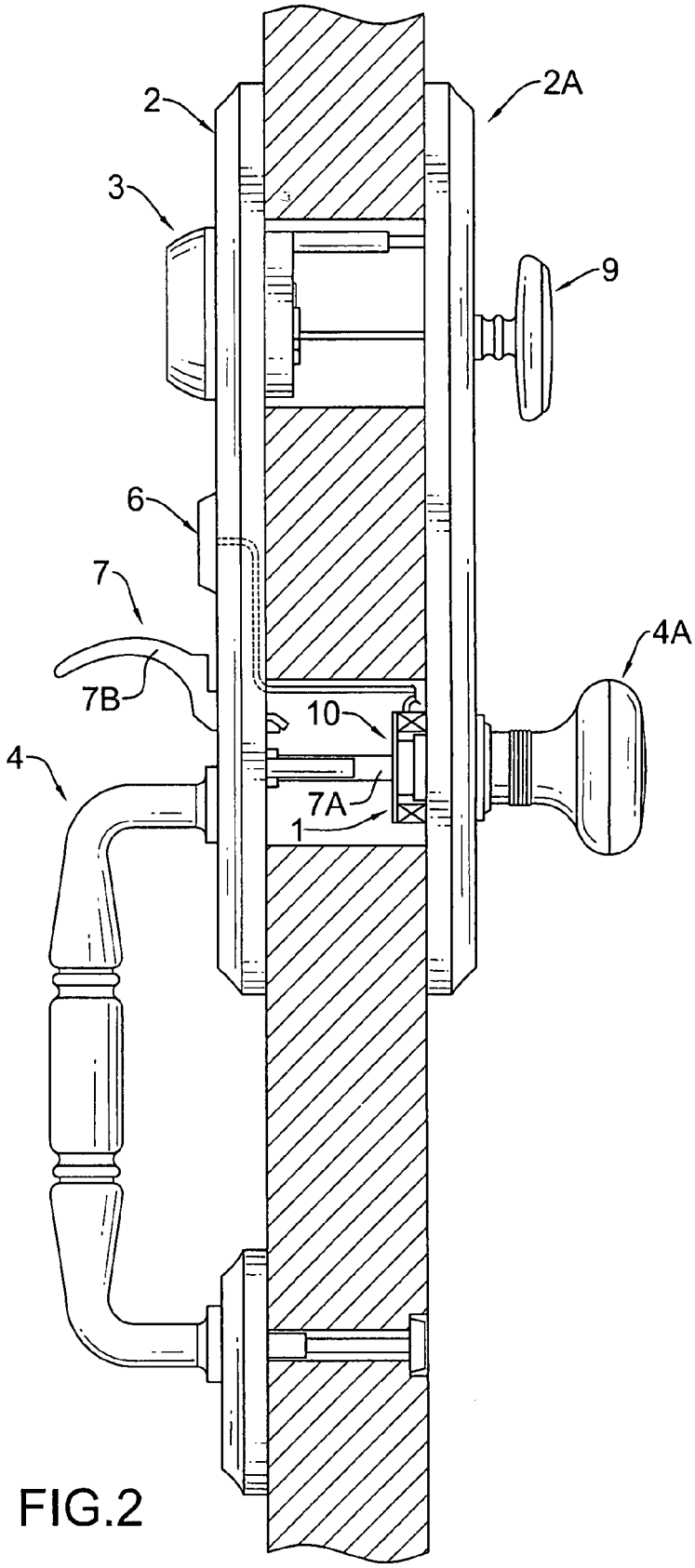
FIG. 2 is a side view in partial section of the door lock with the transmission device in FIG. 1 mounted on a door panel.

With reference to FIGS. 1 and 2, a door lock having electronic and key controlled operation comprises an outer panel (2), an inner panel (2A), an outer handle (4), an inner handle (4A), a lock cylinder (3), an electronic actuator (6), a latch bar actuator (7), an inner lock actuator (9) and a transmission device (1).

The outer and inner panels (2,2A) are mounted respectively on two sides of a door. The lock cylinder (3), electronic actuator (6), latch bar actuator (7) and outer handle (4) are attached to the outer panel (2). The inner lock actuator (9) and the inner handle (4A) are rotatably attached to the inner panel (2A). The lock cylinder (3) is connected to a latch and has a keyhole. When a corresponding key is inserted into the lock cylinder (3), the lock cylinder (3) can be rotated to retract the latch such that the door lock is unlocked. The electronic actuator (6) may be an iris scanner, heat signal detector, a finger print identifier, a chip detecting sensor and other readers capable of detecting and identify biometric, electronic or magnetic data and further output an electronic signal when correct corresponding data is applied. The inner lock actuator (9) is connected to the lock cylinder (3) and locks or unlocks the lock cylinder (3) from inside without the corresponding key.

Figure 9:
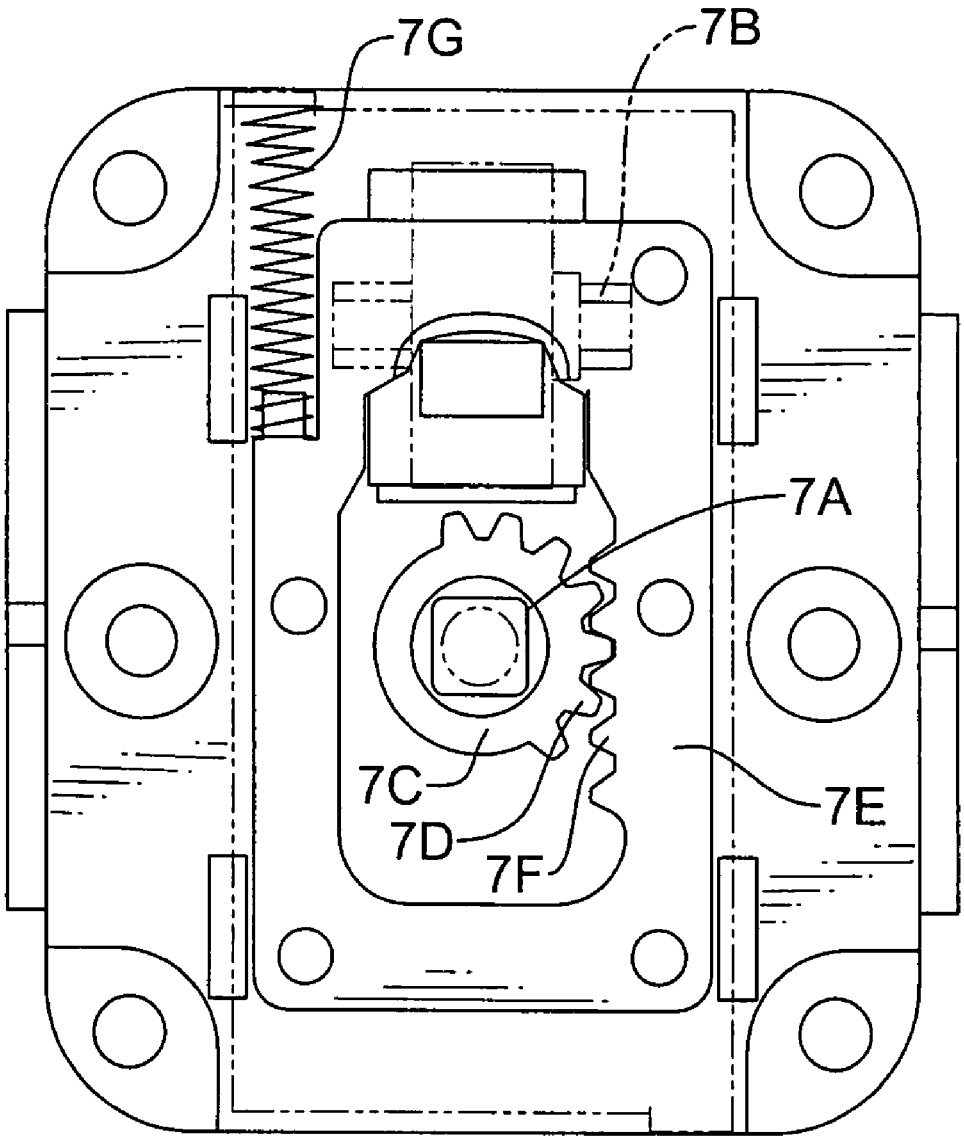
FIG. 9 is an enlarged rear view of a latch bar actuator of the door lock in FIG. 1.

With further reference to FIG. 9, the latch bar actuator (7) may comprise a lever (7B), a driving plate (7E), a driven gear (7C), a driving axial (7A) and a spring (7G). The lever (7B) is pivotally attached to the outer panel (2) and has an outer end and an inner end. The driving plate (7E) is moveably attached the outer panel (2), is connected to the inner end of the lever (7B) and has a through hole. The through hole has an inner surface and multiple teeth (7F) formed on the inner surface. The driven gear (7C) is rotatably attached to the outer panel (2), is held inside the through hole in the driving plate (7E) and has multiple teeth (7D) engaging with the teeth (7F) on the driving plate (7E). The driving axial (7A) is securely attached to the driven gear (7C) and has a non-circular cross section. The spring (7G) is connected between the outer panel (2) and the driving plate (7E) to provide a recoil force to the driving plate (7E). When the outer end of the lever (7B) is pushed, the driving plate (7E) is moved upward by the inner end of the lever (7B) causing the driven gear (7C) and driving axial (7A) to rotate by the teeth (7D, 7F) engaging each other.

The transmission device (1) in accordance with the present invention is mounted between the outer and inner panels (2,2A) and comprises a solenoid switch, a driven device (60) and a linkage assembly (8).

Figure 3:
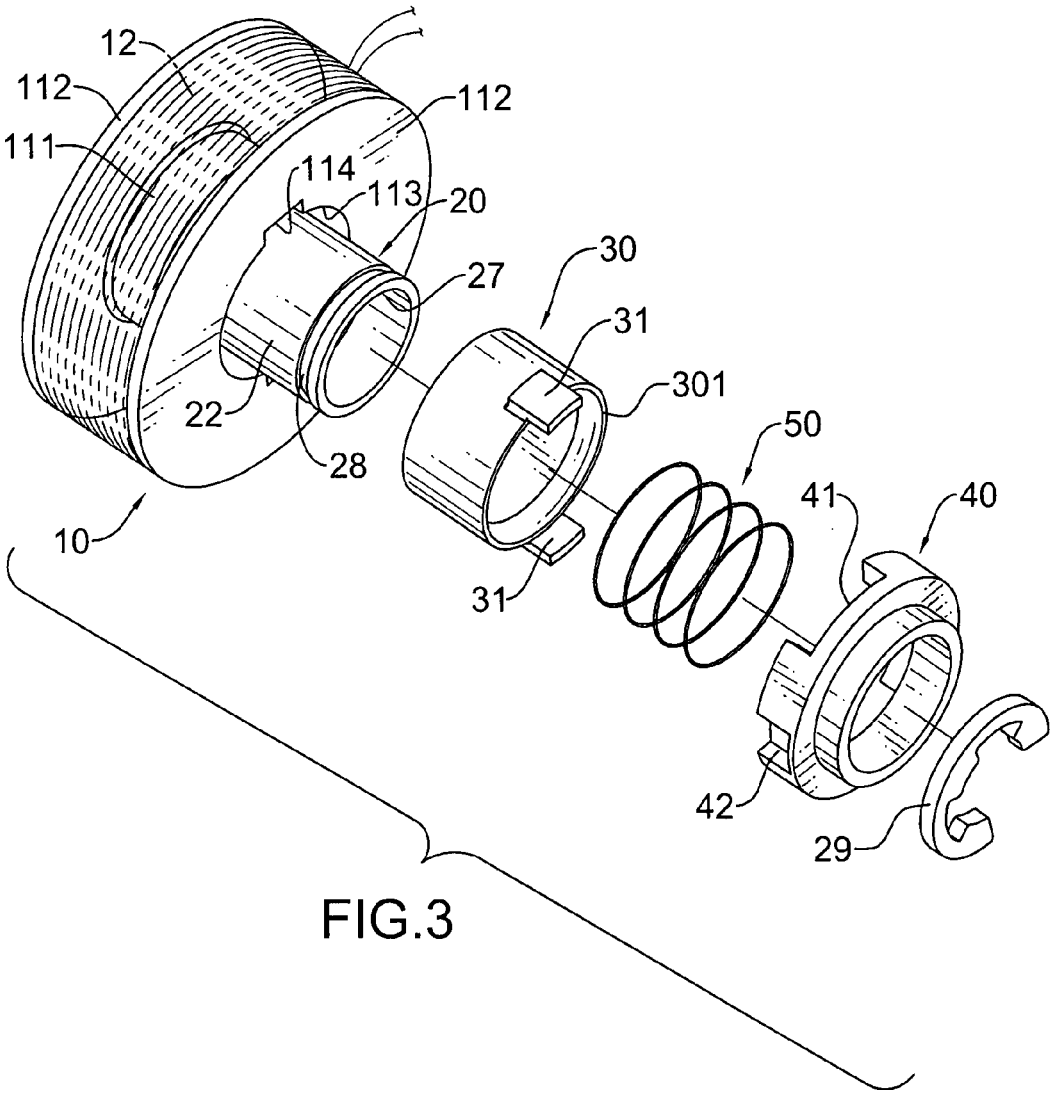
FIG. 3 is a partially exploded perspective view of a first embodiment of a solenoid switch for a transmission device in accordance with the present invention.
Figure 5:
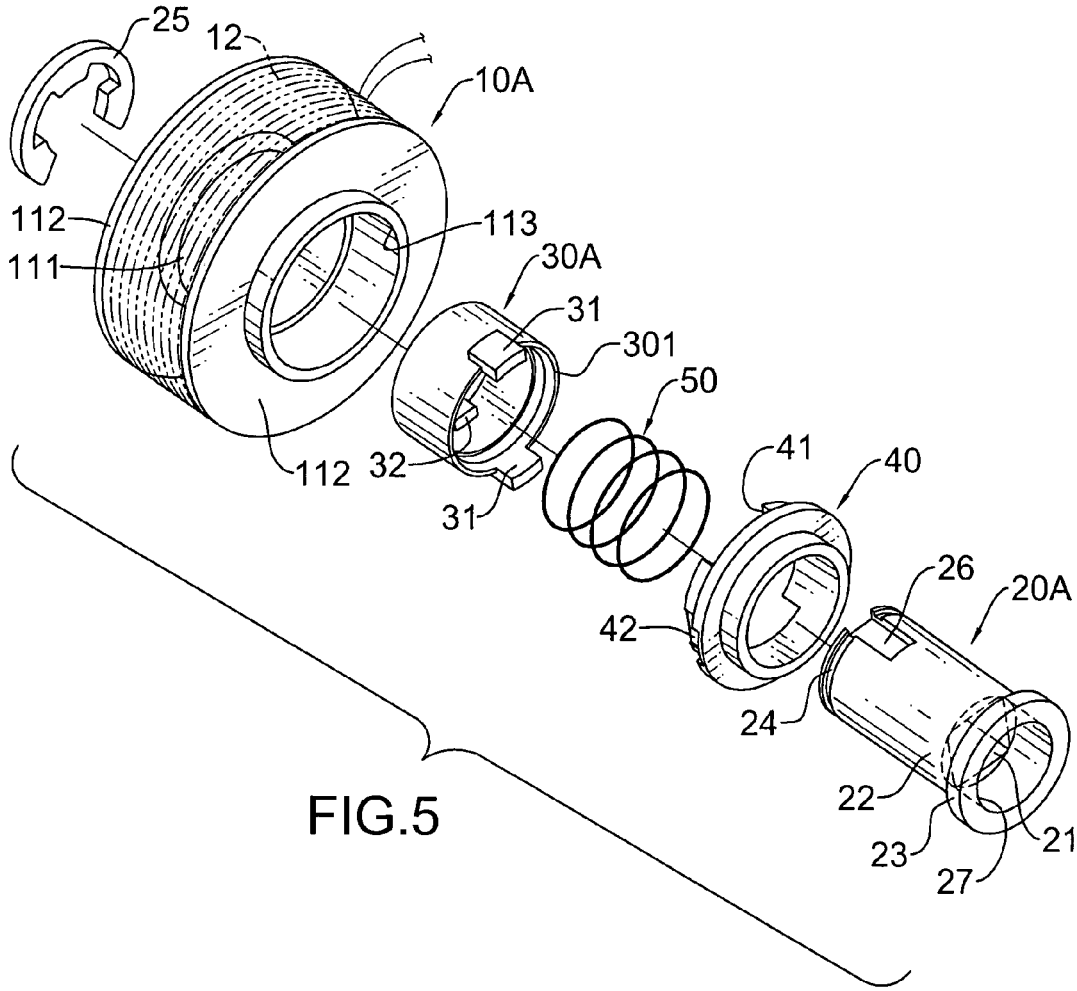
FIG. 5 is a partially exploded perspective view of a second embodiment of a solenoid switch for a transmission device in accordance with the present invention.

With further reference to FIGS. 3 and 5, the solenoid switch in accordance with the present invention comprises a solenoid core (10,10A), a guide tube (20,20A), a sleeve (30, 30A), a clutch cap (40) and a resilient element (50).

The solenoid core (10,10A) comprises a central tube (111), two flanges (112), a receiving hole (113) and a solenoid coil (12). The flanges (112) are formed respectively on two ends of the central tube (111) to define a coil mount between the flanges (112). The receiving hole (113) is defined longitudinally through the solenoid core (10,10A), preferably through the central tube (111), has an inner surface and may have at least one engaging channel (114) defined in the inner surface. The solenoid coil (12) is wound around the solenoid core (10,10A), preferably around the central tube (111) and held in the coil mount between the flanges (112) and is electrically connected to the electronic actuator (6).

The guide tube (20,20A) is mounted in the receiving hole (113) in the solenoid core (10,10A) and has an axial hole (21), a connecting end (22) and a cavity (27).

The axial hole (21) is defined through the guide tube (20, 20A) and has a non-circular cross section corresponding to the driving axial (7A). The connecting end (22) is formed on one end of the guide tube (20,20A) and protruding out of the receiving hole (113) in the solenoid core (10,10A). The cavity (27) is defined in the connecting end (22) of the guide tube (20,20A), communicates with the axial hole (21) and is larger than the axial hole (21).

Figure 4:
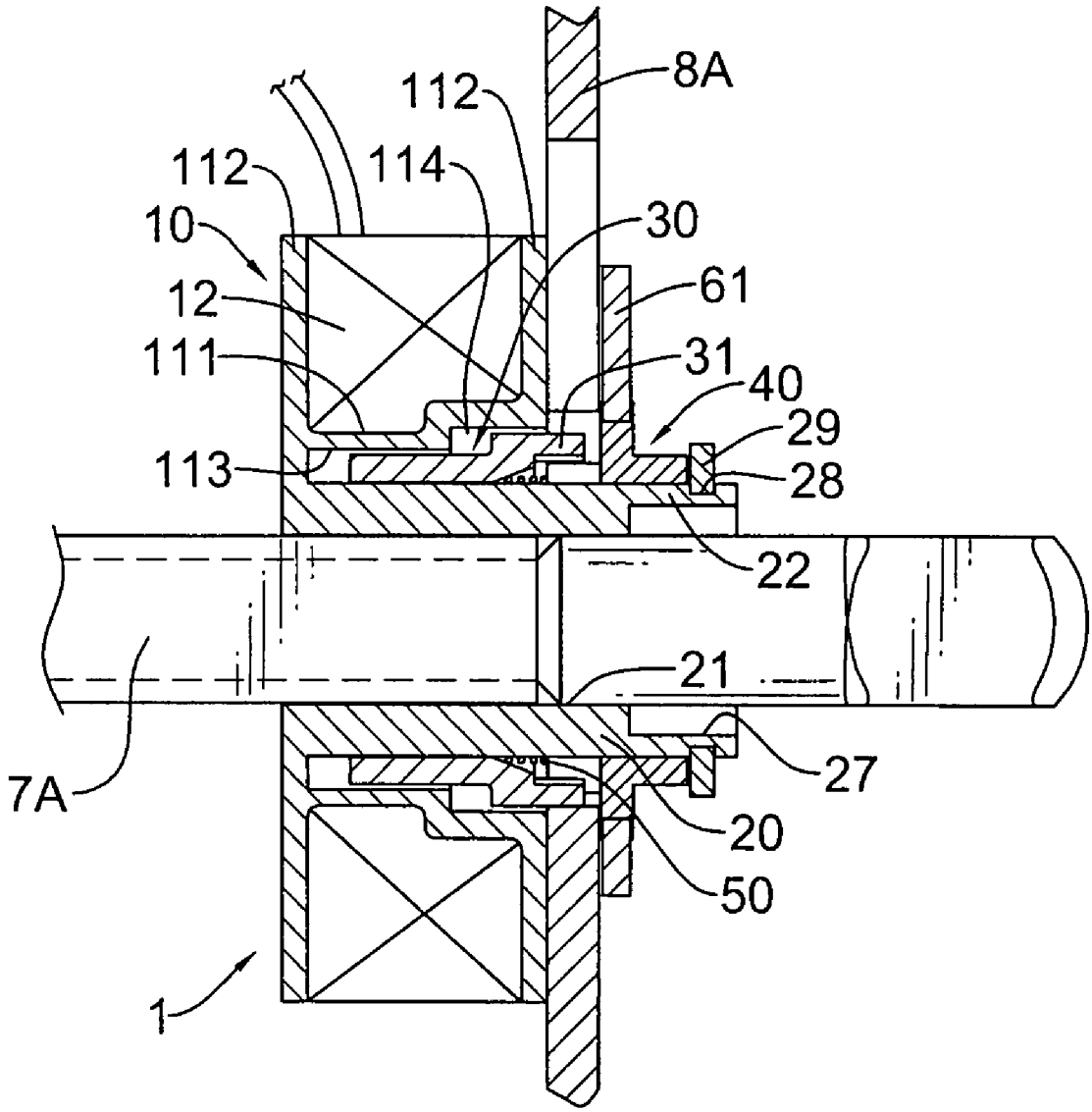
FIG. 4 is a side view in partial section of the transmission device with the solenoid switch in FIG. 3.

With further reference to FIG. 4, in a first embodiment (also shown in FIG. 3), the solenoid core (10) and the guide tube (20) are formed as a single piece. The receiving hole (113) in the solenoid core (10) further has at least one engaging channel (114) defined in an inner surface of the receiving hole (113).

Figure 6:
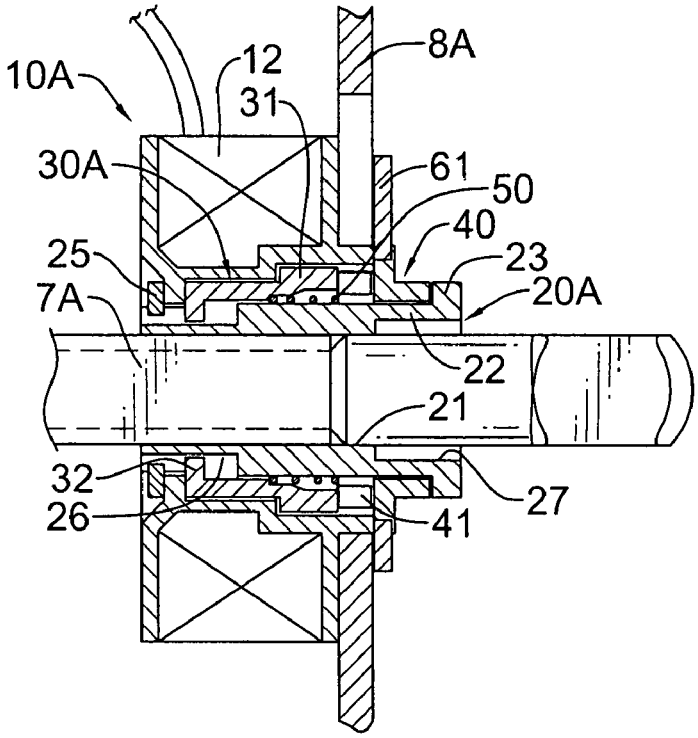
FIG. 6 is a side view in partial section of the transmission device with the solenoid switch in FIG. 5.
Figure 7:
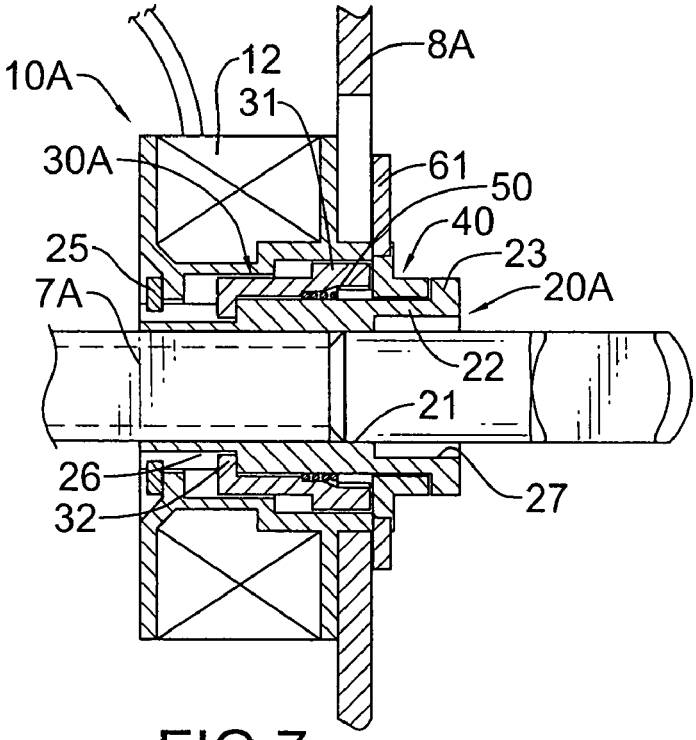
FIG. 7 is an operational side view in partial section of the transmission device in FIG. 5 showing the engaging tabs on the sleeve engaging with the engaging notches in the clutch cap.

With further reference to FIGS. 6 and 7, in a second embodiment (also shown in FIG. 5), the solenoid core (10A) and the guide tube (20A) are separate elements, and the guide tube (20A) further has an engaging end opposite to the connecting end (22), an annular fastening groove (24), a fastening element (25), at least one guiding channel (26) and an annular flange (23). The annular fastening groove (24) is defined around the engaging end, and the fastening element (25) is mounted on the engaging end and abuts the solenoid core (10A) to hold the guide tube (20A) securely on the solenoid core (10A). The fastening element (25) may be a C-ring and may be mounted in the fastening groove (24). Each guiding channel (26) is formed longitudinally in the engaging end. The annular flange (23) is formed around the connecting end (22).

The sleeve (30,30A) is mounted slidably in the receiving hole (113) in the solenoid core (10,10A) and around the guide tube (20,20A) and has a protruding end (301) and at least one engaging tab (31). The protruding end (301) protrudes out of the receiving hole (113). The at least one engaging tab (31) is formed on and protrudes from the protruding end (301) of the sleeve (30,30A) and is disposed adjacent to the connecting end (22) of the guide tube (20,20A) and may be slidably mounted in a corresponding engaging channel (114) in the solenoid core (10). In a preferred embodiment, the sleeve (30,30A) has two engaging tabs (31) formed respectively on the protruding end (301) of the sleeve (30,30A).

In the second embodiment, the sleeve (30A) further has an inner surface and at least one guiding protrusion (32) formed on the inner surface of the sleeve (30A) at an end opposite to the at least one engaging tab (31) and is mounted slidably in and engages with a corresponding guiding channel (26) in the guide tube (20A). With the engagements between the protrusions (32) and the channels (26), the sleeve (30A) will be rotated with the guide tube (20A).

The clutch cap (40) is mounted around the connecting end (22) of the guide tube (20,20A) and has at least one engaging notch (41) and an optional driving notch (42). The engaging notch (41) selectively and detachably engages respectively a corresponding engaging tab (31) on the sleeve (30, 30A) and has a width larger than that of the corresponding engaging tab (31) on the sleeve (30,30A).

In the first embodiment, the guide tube (20) further comprises an annular fastening groove (28) and a fastener (29). The annular fastening groove (28) is defined around the connecting end (22) of the guide tube (20). The fastening element (29) may be a C-ring, is mounted on the connecting end (22), may be in the fastening groove (28) and abuts the clutch cap (40) to hold the clutch cap (40) on the connecting end (22) of the guide tube (20).

In the second embodiment, the annular flange (23) on the guide tube (20A) abuts the clutch cap (40) to hold the clutch cap (40) adjacent to the connecting end (22) of the guide tube (20A).

Each driving notch (42) is defined in the clutch cap (40).

The resilient element (50) is mounted around the guide tube (20,20A), may be a spring and presses the sleeve (30, 30A) away from the clutch cap (40). The driven device (60) is securely connected to the clutch cap (42) of the solenoid switch and comprises an outer ring (61) and an inner ring (62). The outer ring (61) is mounted around with the clutch cap (40) and may have at least one driven boss engaging respectively with the driving notch (42) in the clutch cap (40) and rotates with the clutch cap (40). The inner ring (62) is securely attached co-axially to and driven by the inner handle (4A) and is attached securely to the outer ring (61) using a connector such as a pin, a rivet or the like. Accordingly, when the inner ring (62) is rotated by the inner handle (4A), the outer ring (61) is rotated with the inner ring (62).

Figure 8:
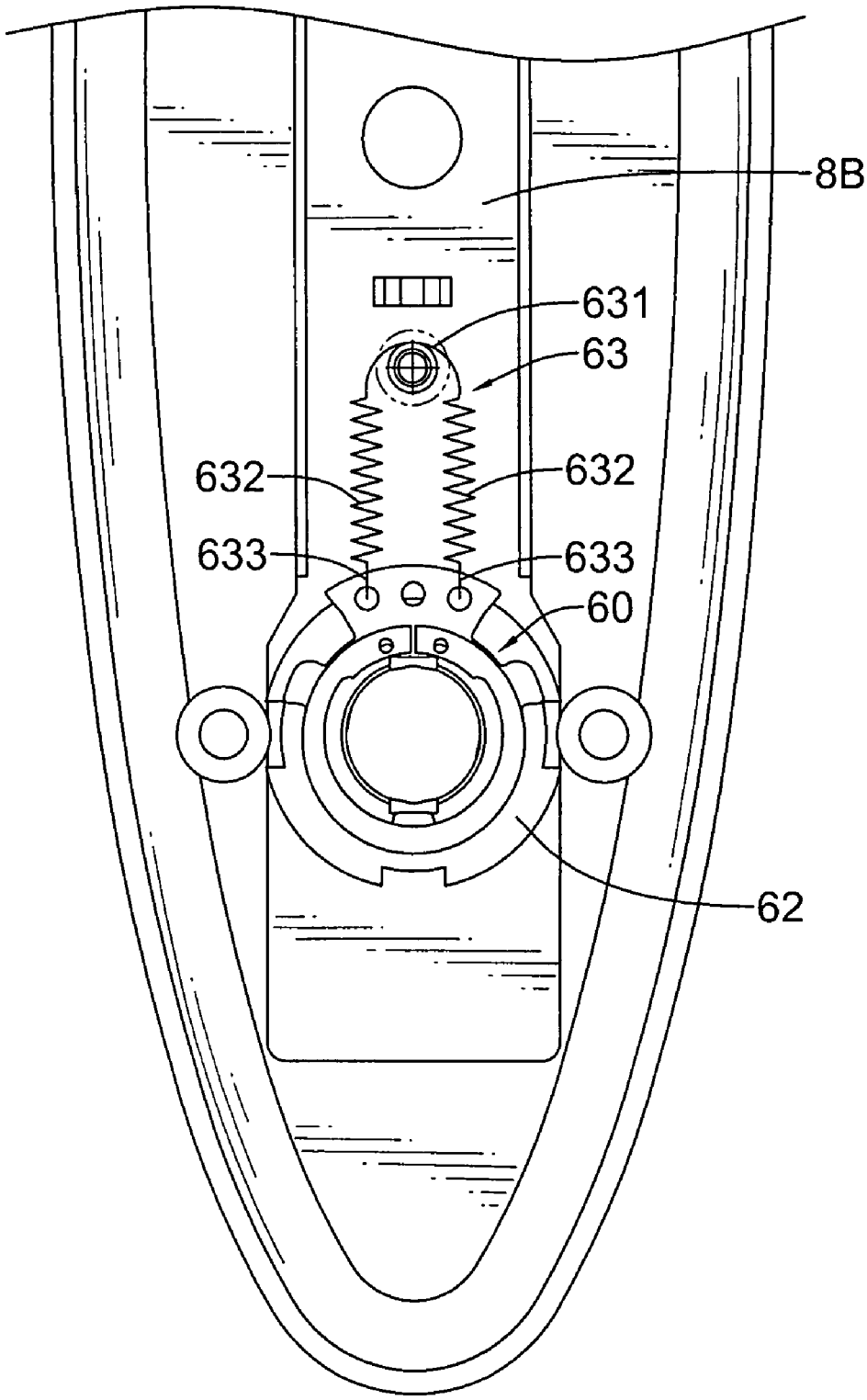
FIG. 8 is an enlarged front view of the transmission device in FIG. 1 showing a connection between an inner ring of a driven device and an inner linkage of a linkage assembly.

With further reference to FIG. 8, the linkage assembly (8) is slidably mounted around the solenoid switch and the latch to retract the latch and comprises an outer linkage (8A), an inner linkage (8B) and at least one spring (63).

The outer linkage (8A) is connected to the latch and to the clutch cap (40) of the solenoid switch with the outer ring (61) of the driven device (60) to be moved up and down when the clutch cap (40) is rotated. The outer linkage (8A) is also connected to the lever between the lock cylinder (3) and the inner lock actuator (9) to be driven by the lever when the lock cylinder (3) is rotated. With the upward movement of the outer linkage (8A), the latch is retracted to unlock the door lock. To move the outer linkage (8A) by the outer ring (61), two driving tabs are formed on and protrude from the outer ring (61), and two driven notches are defined respectively at two sides of the outer linkage (8A) and are mounted around the driving tabs on the outer ring (61). When the outer ring (61) is rotated, the outer linkage (8A) is pushed up relative to the inner linkage (8B) with the driving tabs pushing against the driven notches.

The inner linkage (8B) is connected to the outer linkage (8A), is securely attached to the inner panel (2A) and is connected to the inner ring (62) of the driven device (60).

The at least one spring (63) is connected between the inner linkage (8B) and inner ring (62) of the driven device (60). In a preferred embodiment, the linkage assembly has a single U-shape spring (63) that comprises a middle (631), two resilient segments (632) and two connecting ends (633). The middle (631) is connected to the inner linkage (8B). The resilient segments (632) are formed respectively on two ends of the middle (631). The connecting ends (633) are formed respectively on the resilient segments (632) and are connected respectively to two sides of the inner ring (62) of the driven device (60).

In use, with reference to FIGS. 4 and 6, when the door lock is locked, the lock cylinder (3) is locked and the resilient device (50) causes the engaging tabs (31) on the sleeve (30, 30A) to disengage from the engaging notches (41) in the clutch cap (40). Before the door lock is unlocked, the clutch cap (40) cannot be rotated by the driving axial (7A), so pushing the lever (7B) does not disengage move the latch.

When a user inserts a specific key into the key hole in the lock cylinder (3), the lock cylinder (3) is unlocked and rotated to drive the outer linkage (8A) to move upward and to retract the latch.

In an alternative option, the user can unlock the door lock with the electronic actuator. When a specific signal, such as a finger print, a chip signal or code is input into the electronic actuator (6), the electronic actuator (6) will allow current to flow through the solenoid coil (12) to make the solenoid coil (12) generate a magnetic force. The magnetic force pushes the sleeve (30,30A) along the guide tube (20,20A) to engage the engaging tabs (31) with the engaging notches (41) as shown in FIG. 7. Consequently, when the lever (7B) is pushed, the clutch cap (40) rotates with the driving axial (7A), the solenoid core (10,10A), the guide tube (20,20A) and the sleeve (30,30A). Accordingly, the outer ring (61) is rotated to move the outer linkage (8) upward and retracting the latch to unlock the door.

Therefore, the door lock can be unlocked selectively by key or electronic actuator and is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A solenoid switch for a door lock comprising:

a solenoid core having a receiving hole being defined in the solenoid core; and a solenoid coil being wound around the solenoid core;

a guide tube being mounted in the receiving hole in the solenoid core and having an axial hole being defined through the guide tube; and a connecting end being formed on one end of the guide tube and protruding out of the receiving hole in the solenoid core;

a sleeve being mounted slidably in the receiving hole in the solenoid core and around the guide tube and having a protruding end and at least one engaging tab formed on and protruding from the protruding end of the sleeve and disposed adjacent to the connecting end of the guide tube; and a clutch cap being mounted around the connecting end of the guide tube and having at least one engaging notch selectively and detachably engaging respectively a corresponding engaging tab on the sleeve.

2. The solenoid switch as claimed in claim 1, wherein the guide tube further has an engaging end opposite to the connecting end;

an annular fastening groove defined around the engaging end; and a fastener being mounted in the fastening groove in the engaging end and abutting the solenoid core to hold the guide tube securely on the solenoid core.

3. The solenoid switch as claimed in claim 1, wherein the guide tube further has an annular flange formed around the connecting end and abutting the clutch cap to hold the clutch cap at position on the connecting end of the guide tube.

4. The solenoid switch as claimed in claim 3, wherein the guide tube further has an engaging end opposite to the connecting end and at least one guiding channel being formed longitudinally in the engaging end; and the sleeve further has at least one guiding protrusion formed on an inner surface of the sleeve at an end opposite to the at least one engaging tab and being mounted slidably in a corresponding guiding channel in the guide tube.

5. The solenoid switch as claimed in claim 1 further comprising a resilient element mounted around the guide tube and pressing the sleeve away from the clutch cap.

6. The solenoid switch as claimed in claim 1, wherein the sleeve has two engaging tabs formed respectively on the protruding end of the sleeve.

7. The solenoid switch as claimed in claim 6, wherein the clutch cap has two engaging notches engaging respectively with the engaging tabs on the sleeve; and each engaging notch has a width larger than that of a corresponding engaging tab on the sleeve.

8. The solenoid switch as claimed in claim 1, wherein the guide tube further has a cavity being defined in the connecting end of the guide tube, communicating with the axial hole and being larger than the axial hole.

9. The solenoid switch as claimed in claim 1, wherein the axial hole has a non-circular cross section.

10. A transmission device for an electrical lock comprising:

a solenoid switch comprising a solenoid core having a receiving hole being defined in the solenoid core; and a solenoid coil being wound around the solenoid core;

a guide tube being mounted in the receiving hole in the solenoid core and having an axial hole being defined through the guide tube; and a connecting end being formed on one end of the guide tube and extending out of the receiving hole in the solenoid core;

a sleeve being mounted slidably in the receiving hole in the solenoid core and around the guide tube and having a protruding end and at least one engaging tab formed on and protruding from the protruding end of the sleeve and disposed adjacent to the connecting end of the guide tube; and a clutch cap being mounted around the connecting end of the guide tube and having at least one engaging notch selectively and detachably engaging respectively a corresponding engaging tab on the sleeve;

a driven device being securely connected to the clutch cap of the solenoid switch; and a linkage assembly being slidably mounted around the solenoid switch and comprising an outer linkage being connected to the clutch cap of the solenoid switch;

an inner linkage connected to the outer linkage and the driven device; and at least one spring connected between the inner linkage and the driven device.

11. The transmission device as claimed in claim 10, wherein the guide tube further has an engaging end opposite to the connecting end;

an annular fastening groove defined around the engaging end; and a fastening element mounted in the fastening groove in the engaging end and abutting the solenoid core to hold the guide tube securely on the solenoid core.

12. The transmission device as claimed in claim 10, wherein the guide tube further has an annular flange formed around the connecting end and abutting the clutch cap to hold the clutch cap at position on the connecting end of the guide tube.

13. The transmission device as claimed in claim 12, wherein the guide tube further has an engaging end opposite to the connecting end and at least one guiding channel longitudinally defined in the engaging end; and the sleeve further has at least one guiding protrusion formed on an inner surface of the sleeve at an end opposite to the at least one engaging tab and slidably held respectively in the at least one guiding channel in the guide tube.

14. The transmission device as claimed in claim 10 further comprising a resilient element mounted around the guide tube and having two ends abutting respectively the sleeve and the clutch cap.

15. The transmission device as claimed in claim 10, wherein the sleeve has two engaging tabs formed respectively on two ends of a diameter of the sleeve.

16. The solenoid switch as claimed in claim 15, wherein the clutch cap has two engaging notches engaging respectively with the engaging tabs on the sleeve; and each engaging notch has a width larger than that of a corresponding engaging tab on the sleeve.

17. The transmission device as claimed in claim 10, wherein the guide tube further has a cavity having a diameter larger than that of the axial hole, defined in the connecting end of the guide tube and communicating with the axial hole.

18. The transmission device as claimed in claim 10, wherein the linkage assembly further has a single U-shape spring comprising a middle connected to the inner linkage;

two resilient segments formed respectively on two ends of the middle; and two connecting ends formed respectively on the resilient segments and connected respectively to the driven device.

19. The solenoid switch as claimed in claim 10, wherein the axial hole has a non-circular cross section.

20. A door lock comprising a handle assembly being an inner and outer handle retracting a latch assembly;

a solenoid switch selectively engaging the latch assembly, wherein the solenoid switch comprises a solenoid core having a receiving hole being defined in the solenoid core; and a solenoid coil being wound around the solenoid core;

a guide tube being mounted in the receiving hole in the solenoid core and having an axial hole being defined through the guide tube; and a connecting end being formed on one end of the guide tube and protruding out of the receiving hole in the solenoid core;

a sleeve being mounted slidably in the receiving hole in the solenoid core and around the guide tube and having a protruding end and at least one engaging tab formed on and protruding from the protruding end of the sleeve and disposed adjacent to the connecting end of the guide tube; and a clutch cap being mounted around the connecting end of the guide tube and having at least one engaging notch selectively and detachably engaging respectively a corresponding engaging tab on the sleeve.

* * * * *